United States Patent [19]

Noll et al.

[11] 4,328,857

[45] May 11, 1982

[54] MOUNTING DEVICE FOR HEAT RECOVERY WHEELS

[75] Inventors: Burton A. Noll, Painted Post; Richard P. Suhey, Horseheads, both of N.Y.

[73] Assignee: Corning Glass Works, Corning, N.Y.

[21] Appl. No.: 205,780

[22] Filed: Nov. 10, 1980

[51] Int. Cl.[3] ..... F28D 19/00

[52] U.S. Cl. ..... 165/8; 464/45; 464/163

[58] Field of Search ..... 165/8, 10; 64/29, 30 R, 64/30 E, 27 C, 27 CS, 27 S, 23.5

[56] References Cited

U.S. PATENT DOCUMENTS

| | | | |
|---|---|---|---|
| 996,384 | 6/1911 | Wiard | 64/30 E |
| 1,482,402 | 2/1924 | Lamb | 64/30 E X |
| 3,774,675 | 11/1973 | Yoshiro | 165/8 |
| 4,058,157 | 11/1977 | Wiegard | 165/8 |

FOREIGN PATENT DOCUMENTS

| | | | |
|---|---|---|---|
| 2407442 | 8/1975 | Fed. Rep. of Germany | 165/8 |

*Primary Examiner*—Albert W. Davis
*Attorney, Agent, or Firm*—Richard N. Wardell

[57] ABSTRACT

Disclosed is a mounting device for a ceramic heat recovery wheel having a central bore therein. A metal hub is situated in the bore having a plurality of radially movable shoes for fastening the hub to the wheel. The radially movable shoes each have a radially directed stem with a contact portion abutting the ceramic wheel. The contact portion has a substantially greater cross-sectional area than the stem and in the preferred embodiment is a double cantilevered beam extending from the stem. The cantilevered beams are permitted to bow or flex when subjected to extreme temperatures, thereby permitting radial displacement of the shoe without subjection of the ceramic disk to extreme tensile forces which might cause its breakage.

8 Claims, 4 Drawing Figures

MOUNTING DEVICE FOR HEAT RECOVERY WHEELS

BACKGROUND OF THE INVENTION

The present invention relates in general to rotatable heat exchangers, sometimes known as heat recovery wheels, and, in particular, it relates to a novel mounting structure for such heat recovery wheels.

In gas turbines, furnaces, and other combustion chambers it is desirable to preheat incoming combustion gases with heat extracted from exhaust gases, thereby increasing combustion efficiency. Rotary heat exchangers or heat recovery wheels are particularly desirable for this purpose. Heat recovery wheels are generally mounted for rotation about a central axis. The wheel first rotates through the exhaust gas stream. The wheel contains apertures extending therethrough in an axial direction and as gases flow through the apertures, heat is extracted from the exhaust gas stream and absorbed by the wheel. As the wheel further rotates through the incoming gas stream, heat is given up by the wheel, thus preheating the incoming gas.

While heat recovery wheels may be made from metal, ceramic materials are preferred because ceramic materials have a low coefficient of expansion and a high resistance to oxidation and to corrosion. However, even though ceramics are chosen for the body of such wheels, metals are still employed for the hub. Since the coefficient of thermal expansion of the metal hub differs from the coefficient of expansion of the ceramic, it is generally necessary to securely mount the wheel to its hub while permitting differential thermal expansion of the hub in the radial direction with respect to the wheel. U.S. Pat. No. 3,774,675—Yoshiro discloses such a mounting arrangement. In the Yoshiro patent, pads are provided which are radially expandable within the bore of the ceramic heat recovery wheel. A plurality of spring means are provided which bias the pads radially outwardly. One problem associated with the aforementioned Yoshiro patent is that the pads shown therein create undesirable tensile forces upon the ceramic structure. It is well known that ceramics are able to withstand large compressive forces, however, they are unable to withstand tensile forces of the same magnitudes. Accordingly, it would be desirable to provide an improved mounting structure, over that disclosed by Yoshiro, which minimizes the tensile forces exerted upon a ceramic disc.

SUMMARY OF THE INVENTION

The aforementioned objective is achieved by the provision of a mounting device for a heat recovery wheel, the wheel being a ceramic disk having a central bore therein. The mounting device includes a first hub portion on one side of the wheel which is axially aligned therewith, the hub having a central portion extending into the bore. At least three radially movable shoes are provided which are equiangularly spaced about the bore. The shoes each have a radially extending stem with a contact portion projecting therefrom in contact with the ceramic disk. The contact portion has a surface area substantially larger than the cross-section of the stem from which it projects. Further, in the preferred embodiment, the contact area is a double cantilevered beam extending from the stem. Means are then provided for applying a radially directed force to the stems whereby the cantilevered beams are biased against the inside diameter of the bore of the ceramic disk. The aforementioned cantilevered beams allow for the application of radial force to the ceramic disk over a surface area greater than that permitted in the aforementioned Yoshiro patent thereby decreasing the localized application of tensile force applied to the ceramic disk.

Moreover, in accordance with one aspect of the present invention, the aforementioned cantilevered beams are curved and have a radius of curvature greater than the radius of curvature of the bore of the heat recovery wheel. In this manner, as the shoes extend radially as a result of expansion, the curved cantilevered beams are caused to bow thereby permitting radial displacement of the shoe without the subjection of the ceramic disk to undue forces.

RELATED APPLICATION

Ser. No. 205,779, filed Nov. 10, 1980, by the present applicants discloses an alternative mounting device incorporating certain aspects of the present invention and that disclosure is incorporated herein by reference.

BRIEF DESCRIPTION OF THE DRAWINGS

The present invention will be more fully appreciated by reference to the accompanying drawings in which.

DETAILED DESCRIPTION OF THE PREFERRED EMBODIMENT

Figure 1:
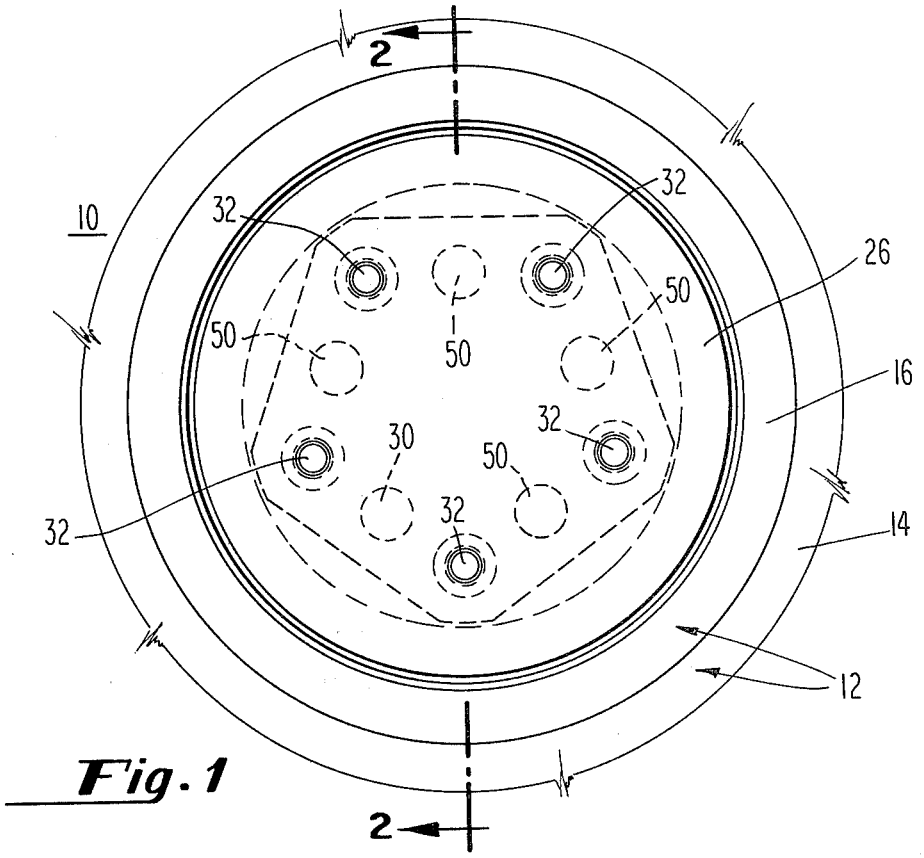
FIG. 1 is an elevational view of the novel mounting device of the present invention.

FIG. 1 shows the central portion of a rotatable heat recovery wheel generally at 10. The wheel 10 includes a round ceramic disk shown generally at 12. The ceramic disk 12 contains an apertured portion 14 and a non-apertured portion or wheel hub 16. The apertured portion 14 contains a plurality of apertures, (not shown) the longitudinal axes of which extend parallel to the axis of the wheel 10. In the preferred embodiment, the apertured portion 14 of the ceramic disk 12 is made according to the teachings of U.S. Pat. No. 3,790,654, usually as segments which are later cemented together.

Figure 2:
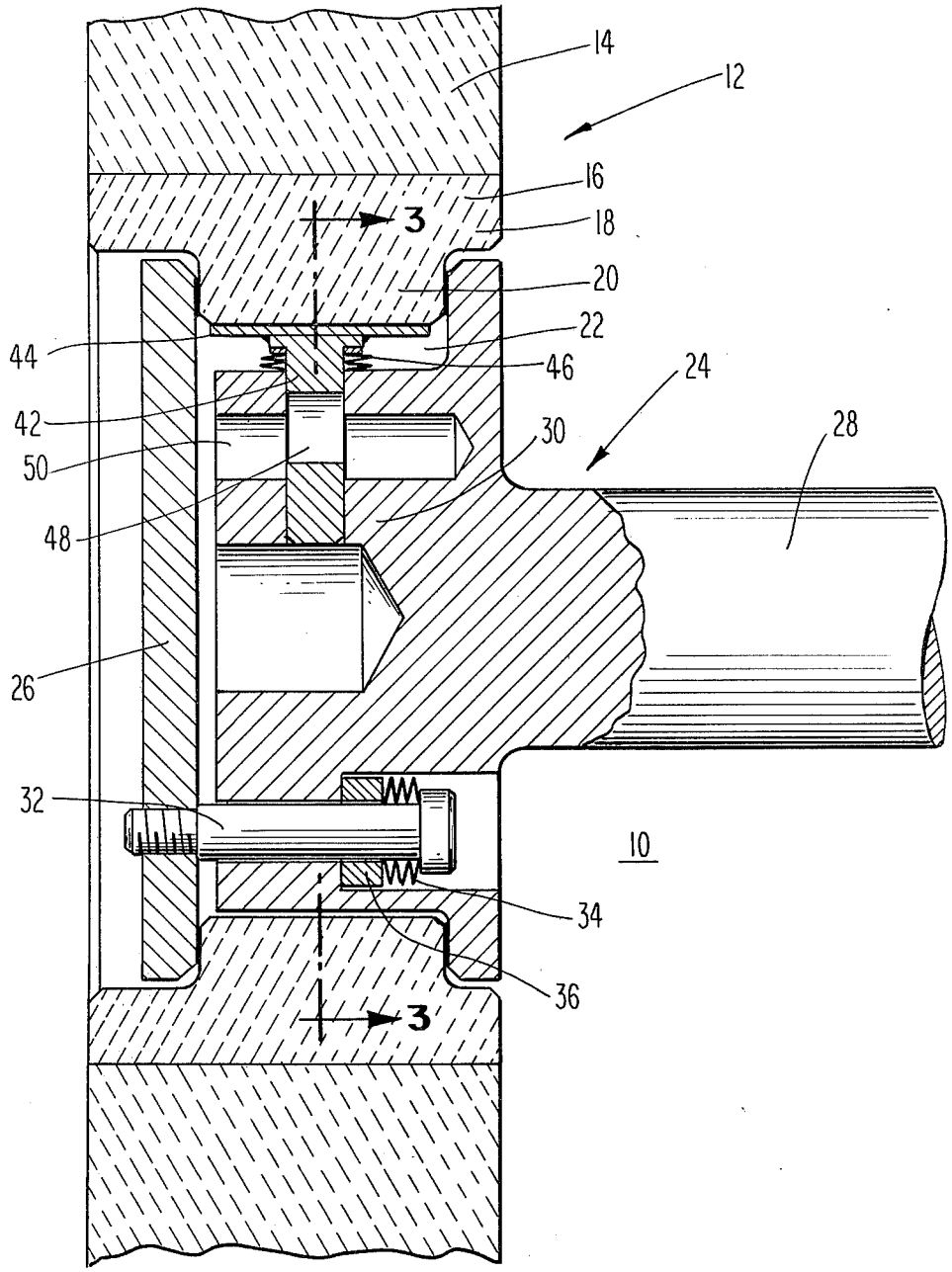
FIG. 2 is a cross-sectional view taken along lines 2—2 of FIG. 1.

As may best be seen from FIG. 2, the non-apertured portion 16 of the ceramic disk 12 is comprised of a peripheral portion 18 having an axial dimension equal to that of the apertured portion 14 and central shoulder portion 20 having a lesser axial dimension. The ceramic disk 12 includes a central bore 22 therein. Situated on opposite sides of the heat recovery wheel 10 at the bore 22 and axially aligned therewith is a metal driver hub having a first hub portion 24 and a second hub portion or face plate 26. The first hub portion 24 includes a central portion 30 extending into the bore 22 of the heat recovery wheel 10 and a shaft 28 projecting away from the bore 22 and axially aligned with the disk 12. The first hub portion 24 and the second hub portion 26 are retained in position with respect to one another by means of bolts 32. The first and second hub portion 24 and 26 clamp the central shoulder portion 20 of the ceramic disk 12 therebetween. Bolts 32 threadedly engage the second hub portion 26 as shown. Moreover, Belleville springs 34 are situated between the heads of bolts 32 and spacers 36 so as to permit movement of the first and second hub portion 24 and 26 in the axial direction as the ceramic disk 12 expands and contracts.

Figure 3:
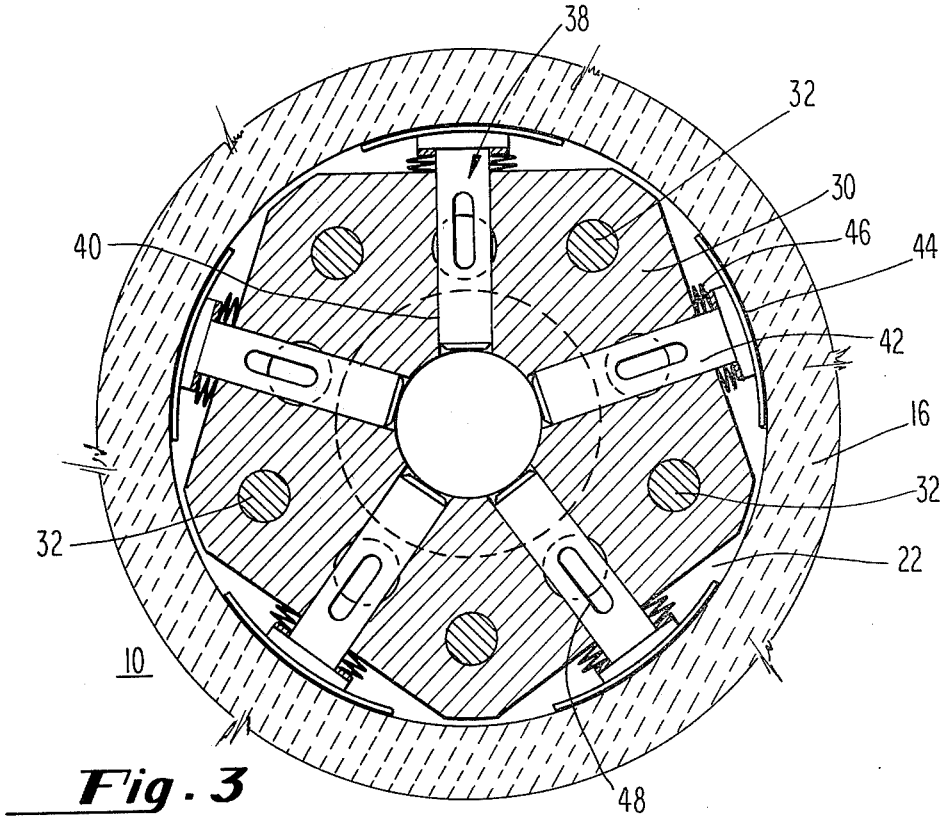
FIG. 3 is a cross-sectional view taken along lines 3—3 of FIG. 2.

As may best be seen from FIG. 3, the central portion 30 of the first hub portion 24 is polygonal in cross-section and, in the embodiment shown in FIG. 3, the central portion 30 has the cross-sectional shape of a pentagon. Radially extending from the central portion 30 of the first hub portion 24 in a direction perpendicular to the sides of the polygonal cross-section are a plurality of radially movable shoes 38. The number of shoes 38 is equal to the number of sides of the polygonal cross-section of the central portion 30 of the first hub portion 24. The shoes 38 travel in guides 40 formed in the central portion 30 of the first hub portion 24. The shoes 38 each comprise a stem portion 42 which mates with the guides 40, the shoes being slidably engaged therewith. At the radial extremity of the stems 42 are found contact portions 44 which abut the inside periphery of the ceramic disk 12 at the bore 22. In accordance with an important aspect of the present invention, the contact portions 44 of each of the shoes 38 have a surface area which is substantially greater than the cross-sectional area of the stem portions 42 taken along a plane perpendicular to the axis of the stem portions 42.

A spring means 46 is provided for applying a radially directed force to the shoes 38 thereby keeping the contact portion 44 in abutting relationship with the ceramic disk 12. The spring means 46 preferably comprises Belleville springs which abut against the central portion 30 of the first hub portion 24 and also against the contact portion 44. Each of the stem portions 42 of the shoes 38 contains a slot 48 formed therein. The slots 48 align with apertures 50 formed in the central portion 30 of the first hub portion 24. A suitable tool (not shown) may be inserted into the apertures 50 for retracting the shoes 38 radially inwardly for insertion of the first hub portion 24 into the bore 22 of the ceramic disk 12. After the hub portion is properly inserted, the tool may be removed allowing the shoes 38 to be displaced radially for engagement of the contact portion 44 with the ceramic disk 12.

Figure 4:
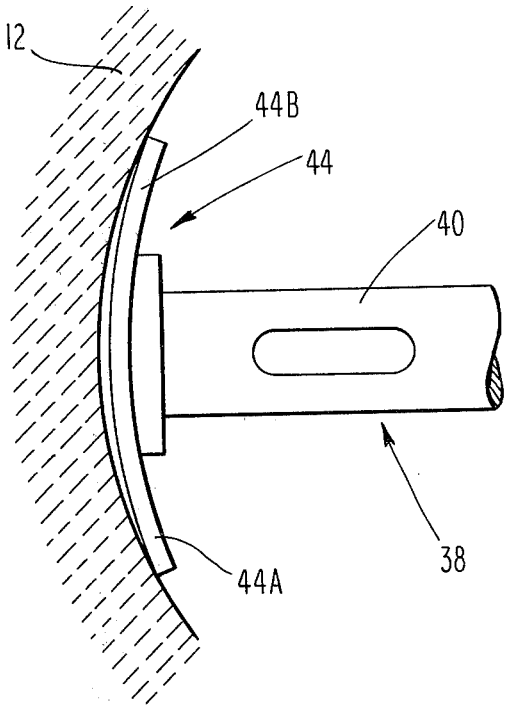
FIG. 4 is an exploded view of one of the five radially extendable shoes shown in FIG. 3.

Referring now to FIG. 4, one of the individual shoes 38 will be seen in detail. As shown in FIG. 4, the contact portion 44 of the shoe 38 comprises a double cantilevered beam which is centrally supported at the radial extremity of the stem 40 having unsupported ends 44A and 44B projecting therefrom. As shown in FIG. 4, the double cantilevered beam of the contact portion 44 is a curved body which, in accordance with this aspect of the present invention, has a radius of curvature slightly greater than the radius of curvature of the inside diameter of the ceramic disk 12. In this manner, the ends 44A and 44B of the beam tend to bow or flex with the radial displacement of the shoe 38, thus preventing the application of radially directed force at a single point along the inside diameter of the disk 12 as the ceramic material expands.

While a particular embodiment of the present invention has been shown and described, it will be appreciated that other modifications of the invention, not specifically mentioned, will occur to those skilled in the art and are intended to be included within the scope of the appended claims.

What is claimed is:

1. A mounting device for a heat recovery wheel having a central bore therein comprising:

a first hub portion on one side of said wheel, and axially aligned therewith, said first hub having a central portion extending into said bore;

a plurality of radially movable shoes situated in said bore, said shoes having radially extending stems and contact portions at the radial extremity of said stems, the surface area of said contact portions being substantially greater than the cross-sectional area of said stems taken in a plane perpendicular to the axes thereof, and said contact portions each comprising double cantilevered beams extending from said stems; and a means for applying a radially directed force to said shoes whereby the contact portions of said shoes are biased against said wheel at the periphery of said bore.

2. The mounting of claim 1 wherein said shoes project from said central portion.

3. The mounting of claim 1 wherein said plurality is greater than or equal to three.

4. The mounting of claim 4 wherein the cross section through the axis of said central portion is a polygon having the same number of sides as said plurality.

5. The mounting of claim 1 wherein said central portion includes at least three guides, each of said stems being supported by said guides.

6. The mounting of claim 1 wherein said force applying means comprise Belleville springs.

7. The mounting of claim 1 wherein said cantilevered beams have a radius of curvature greater than the radius of curvature of said bore.

8. The mounting device of claim 1 further comprising a second hub portion on the opposite side of said wheel and axially aligned therewith, said first and second hubs being joined so as to clamp said wheel therebetween.

* * * * *

UNITED STATES PATENT AND TRADEMARK OFFICE

CERTIFICATE OF CORRECTION

PATENT NO. : 4,328,857

DATED : May 11, 1982

INVENTOR(S) : Burton A. Noll and Richard P. Suhey

It is certified that error appears in the above-identified patent and that said Letters Patent are hereby corrected as shown below:

Column 4, line 37, Claim 4, line 1, the number "4" should read -- 3 --.

Signed and Sealed this

*Tenth* Day of *August 1982*

[SEAL]

*Attest:*

GERALD J. MOSSINGHOFF

*Attesting Officer*

*Commissioner of Patents and Trademarks*